US005939960A

United States Patent [19]

Godel et al.

[11] Patent Number: 5,939,960

[45] **Date of Patent: *Aug. 17, 1999**

[54] MOTOR VEHICLE STARTER HAVING IMPROVED MEANS FOR THE ELECTRICAL CONNECTION OF THE CONTACTOR

[75] Inventors: Laurent Godel, Rochetoirin; Robert Jacquet, Villeurbanne; Bernard Carre, Moullins, all of France

[73] Assignee: Valeo Equipements Electriques Moteur, Creteil, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/889,423

[22] Filed: Jul. 8, 1997

[30] Foreign Application Priority Data

Jul. 10, 1996 [FR] France ..... 96 08717

[51] Int. Cl.[6] ..... H01H 67/02

[52] U.S. Cl. ..... 335/126; 335/202

[58] Field of Search ..... 335/126, 131–2, 335/202; 200/257–8, 293–309; 361/610.2, 608, 624

[56] References Cited

U.S. PATENT DOCUMENTS

| | | | |
|---|---|---|---|
| 4,521,757 | 6/1985 | Hastings et al. | 335/126 |
| 4,887,056 | 12/1989 | Kajino et al. | 335/126 |
| 5,132,653 | 7/1992 | Nakatake et al. . | |
| 5,245,304 | 9/1993 | Zenmei | 335/126 |
| 5,521,567 | 5/1996 | Devonald, III et al. | 335/132 |
| 5,677,655 | 10/1997 | Hinata et al. | 335/132 |

FOREIGN PATENT DOCUMENTS

| | | |
|---|---|---|
| 0 349 210A2 | 1/1990 | European Pat. Off. . |
| 2 656 445 | 6/1991 | France . |
| 38 22 848A1 | 1/1990 | Germany . |

OTHER PUBLICATIONS

French Search Report dated Apr. 11, 1997.

Patent Abstracts of Japan, vol. 18, No. 69 (E–1502), Feb. 4, 1994 & JP 05 284400 A.

Patent Abstracts of Japan, vol. 15, No. 32 (M–1073), Jan. 25, 1991 & JP 02 272183A.

*Primary Examiner*—Lincoln Donovan

*Attorney, Agent, or Firm*—Morgan & Finnegan, LLP

[57] ABSTRACT

A motor vehicle starter includes an electromagnetic contactor, which is equipped with an external electrical terminal adaptor. The terminal adaptor has a body of insulating material. At least one conductive connecting strip is contained within the insulating body, with one end of the strip projecting out of the adaptor body for connection to one of the contactor terminals. The other end of the connecting strip is connected electrically to a supplementary terminal which projects out of the adaptor body so as to be in a position or orientation which is different from that of the contactor terminal to which it is connected.

12 Claims, 3 Drawing Sheets

MOTOR VEHICLE STARTER HAVING IMPROVED MEANS FOR THE ELECTRICAL CONNECTION OF THE CONTACTOR

FIELD OF THE INVENTION

The present invention relates to starters for motor vehicles.

More particularly, the invention relates to a starter for a motor vehicle, of the type comprising an electromagnetic contactor, having a movable contact arranged within a housing of the contactor, the movable contact being adapted to cooperate electrically with fixed contacts, each of which has a power terminal, the bodies of the power terminals projecting outside the housing through a transverse end wall of the latter, so as to enable the said fixed contacts to be connected, through the power terminals, to a power supply circuit for the electric motor of the starter, and of the type in which the contactor is controlled by an electrical control line which is connected to the body of a control terminal which projects outside the housing through the said transverse end wall of the latter.

BACKGROUND OF THE INVENTION

The three main terminals of the starter contactor (also referred to herein, and in the Claims, as the "contactor terminals") therefore all lie in the same zone, and all three are oriented in the same direction, which corresponds substantially to the main axis of the contactor. Having regard to the disposition and orientation of the electric motor within the engine compartment of the vehicle, i.e. the compartment that contains the engine which is equipped with the starter, it is this disposition and orientation that determines that of the contactor terminals within the engine compartment. However, often there is not sufficient room between the part of the contactor that has the contactor terminals and the other components of the engine, or surrounding components of the vehicle within the engine compartment.

Where there is insufficient space, or this space is reduced, the contactor terminals can often be virtually inaccessible. During assembly of the vehicle, or during its working life when repairs have to be carried out, this difficulty of access can be a great nuisance: for example, it may be extremely difficult, or even impossible, to pass the connecting spade terminals on the end of the leads that have to be connected to the contactor, and the associated nuts, into position for attachment to the starter.

In any case, as is well known, it is often difficult to find enough space to manipulate the tools, such as spanners or screwdrivers, that are used in tightening or loosening terminal connections within an engine compartment.

Thus, for each engine of each model of vehicle, the starter casing, and essentially the casing or housing of the contactor, have to be designed differently in order to enable these various operations to be carried out in a relatively convenient way. This individualised, or unstandardised, design for starters, different for each application, leads to a multiplication of different models of starter, and to a great profusion of models which it is then necessary to hold in stock.

DISCUSSION OF THE INVENTION

An object of the present invention is to provide a motor vehicle starter of an improved form which overcomes the above mentioned drawbacks.

According to the invention, a starter for a motor vehicle, of the type comprising an electromagnetic contactor, having a movable contact arranged within a housing of the contactor, the movable contact being adapted to cooperate electrically with fixed contacts, each of which has a power terminal, the bodies of the power terminals projecting outside the housing through a transverse end wall of the latter, so as to enable the said fixed contacts to be connected, through the power terminals, to a power supply circuit for the electric motor of the starter, and of the type in which the contactor is controlled by an electrical control line which is connected to the body of a control terminal which projects outside the housing through the said transverse end wall, is characterised in that the contactor is equipped with an electrical connector or terminal adaptor, which is attached to the outside of the housing of the contactor and which is carried by the latter, the said terminal adaptor comprising a body of an insulating material, with at least one electrically conductive connecting element being received within the said body, one end of the or each said connecting element being an entry end which projects out of the insulating body for connection to an appropriate one of the said power terminals or to the control terminal, the other end of the connecting element being an exit end connected electrically to a corresponding supplementary terminal, which projects away from the insulating body and which lies in a position, and/or in an orientation, which is different from that of the power or control terminal with which the supplementary terminal is associated.

According to a preferred feature of the invention, the said entry end of the or each connecting element includes means for connecting the entry end electrically and fastening it mechanically on the corresponding contactor terminal, whereby to ensure at least partially the mechanical fastening of the terminal adaptor with respect to the contactor.

Preferably, the insulating body of the terminal adaptor includes means for locating the latter mechanically on the housing of the contactor.

The said mechanical locating means for the terminal adaptor are preferably means for fastening by mating engagement of complementary elements.

According to another preferred feature of the invention, the insulating body of the connector or terminal adaptor extend longitudinally along a side wall of the housing of the contactor in a direction substantially at right angles to the plane of the said transverse end wall of the housing of the contactor.

Preferably, at least one of the supplementary terminals of the terminal adaptor extends transversely with respect to the insulating body of the terminal adaptor, in an orientation which is substantially at right angles to that of the power or control terminal of the contactor with which the supplementary terminal is electrically associated through the terminal adaptor.

According to yet another preferred feature of the invention, the insulating body of the terminal adaptor has the general form of a plate adjacent to a side wall of the housing of the contactor, with the entry end of the or each connecting element projecting transversely out of the insulating adaptor body in the vicinity of a first longitudinal end of the adaptor body and in a first direction which is substantially at right angles to the plane of the said plate, and the associated supplementary terminal projects transversely away from the insulating adaptor body in the vicinity of the other longitudinal end of the adaptor body opposed to the said first end, but in the opposite direction from the said first direction.

Preferably, the or each connecting element is a connecting bar of conductive material, of elongate form and having a rectangular cross section, the opposed ends of which are configured, for example by bending, firstly so as to constitute the said entry end, and secondly, to constitute the said exit end connected electrically to the associated supplementary terminal.

In preferred embodiments of the invention, the or each connecting element is mounted in a corresponding recess of complementary form, formed in the insulating body of the connector or terminal adaptor, the connecting element being retained in position in the corresponding said recess by retaining lugs and/or by a cover which at least partially obturates an open face of the recess, so that the connecting element is thereby held within its corresponding recess.

The or each connecting element is preferably made in the form of an insert which is encapsulated within the insulating body of the terminal adaptor, the latter being then molded around the connecting element or elements.

The insulating body of the terminal adaptor is preferably made in a plastic material, such as for example polyamide, as a one-piece molded component.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
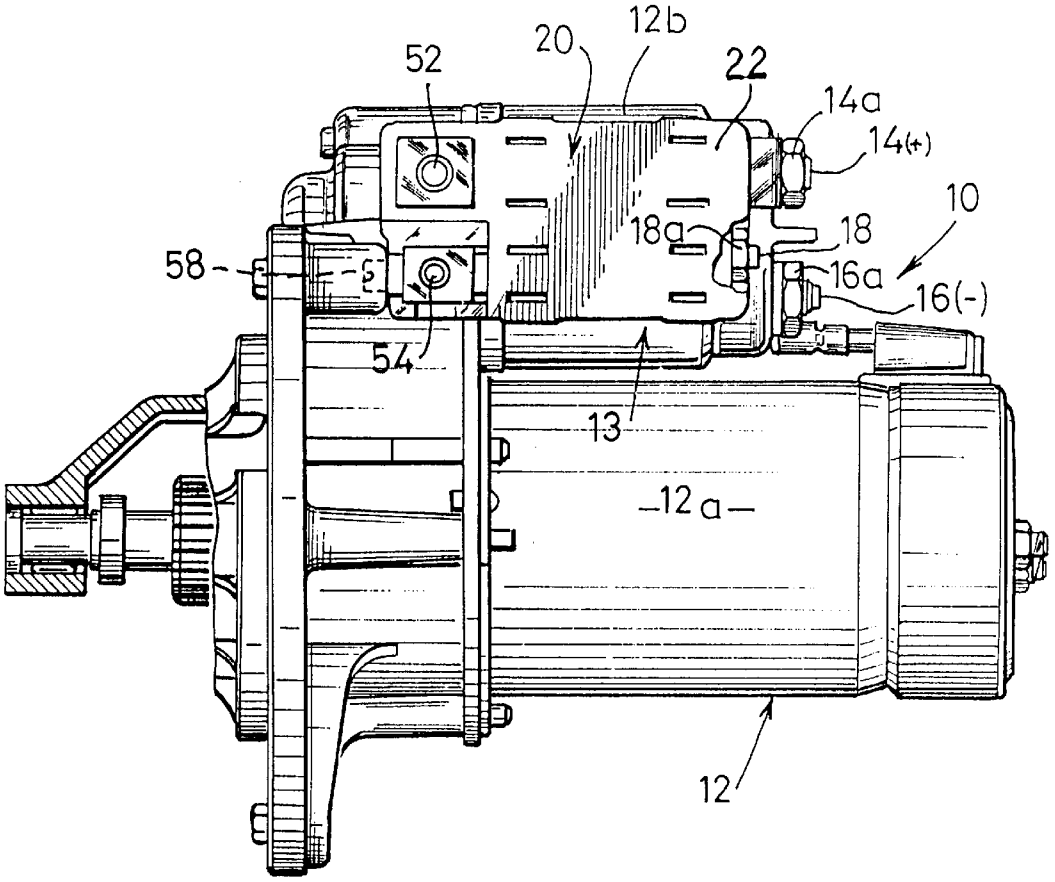
FIG. 1 is a side view of a starter equipped with a connector in accordance with the present invention.
Figure 2:
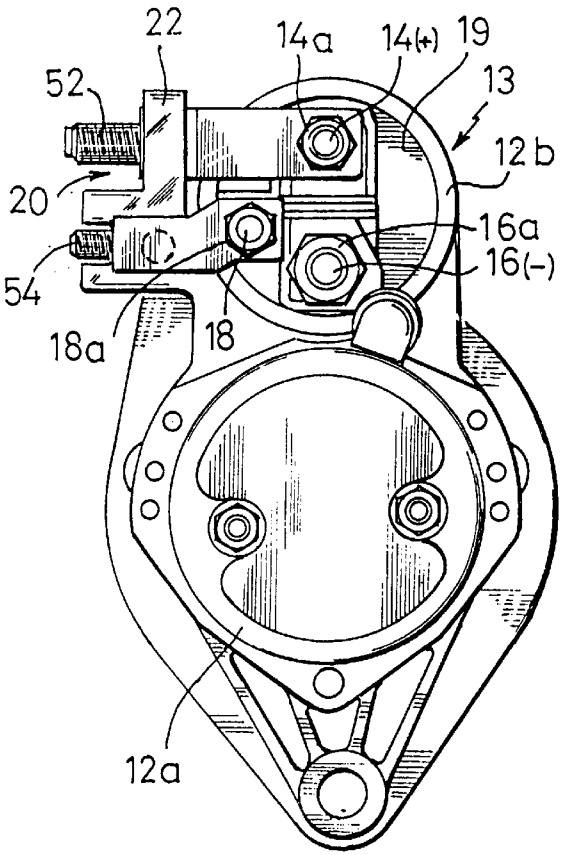
FIG. 2 is an end view of the same starter as in FIG. 1, as seen from the right hand side of FIG. 1.

Reference is first made to FIGS. 1 and 2, which show a starter for a motor vehicle. This starter is generally indicated by the reference numeral 10. The starter 10 is enclosed within a casing 12 which has two main parts, namely a lower part 12*a* which encloses the electric motor of the starter 10, and an upper part 12*b* which encloses an electromagnetic contactor 13. In FIGS. 1 and 2, the means for fastening the starter to the vehicle are not shown.

The contactor 13 terminates at its right hand axial end (with reference to FIG. 1) in a set of contactor terminals 14, 16 and 18. The body of each of these terminals is in the form of a threaded shank which projects axially through the transverse end wall 19 of the upper part 12*b* of the casing 12 of the contactor 13. The contactor 13 has, in the usual way, a moving contact which is engaged with, and disengaged from, a pair of fixed contacts by means of a solenoid winding energised and de-energised in response to control signals. The two terminals 14 and 16 are the power terminals associated with the fixed contacts, through which the starter motor is supplied with power. The terminal 18 is a control terminal for supplying the control signals to the contactor 13. In this example, the bodies of the three terminals 14, 16 and 18 are shown in the form of threaded shanks of screw type terminals, which normally receive fastening nuts 14*a*, 16*a* and 18*a* for securing spade terminals, which are attached respectively to the ends of the electrical conductors of the power circuit for the starter. In the case of the control terminal 18, such a spade terminal is attached to the end of an electric control wire for the contactor 13. In this example, the negative power terminal 16 is connected to ground (earth), which consists in practice of the metal structure of the vehicle in the usual way, and the terminal 14 is the positive power terminal.

In order to enable for example the two terminals 14 and 18 to be easily connected in a modular way, even under cramped conditions in the engine compartment of the vehicle, such as to prevent access to these terminals, or to at least make it difficult, an electrical connector or terminal adaptor 20 is provided. The structure and purpose of this connector 20 will now be explained in detail.

The connector or adaptor 20 has a body 22 which is made of a strong, durable insulating material such as to be resistant to the conditions that prevail within the engine compartment. Such conditions include temperatures variable over a wide range, drenching or spraying with water containing corrosive products and small stones, and spillages of fuel and oil. The material chosen for this purpose preferably has elastic properties such that the adaptor body 22 is slightly deformable without suffering any lasting harm. It may in particular consist of a polyamide, in particular a molded polyamide.

Figure 3:
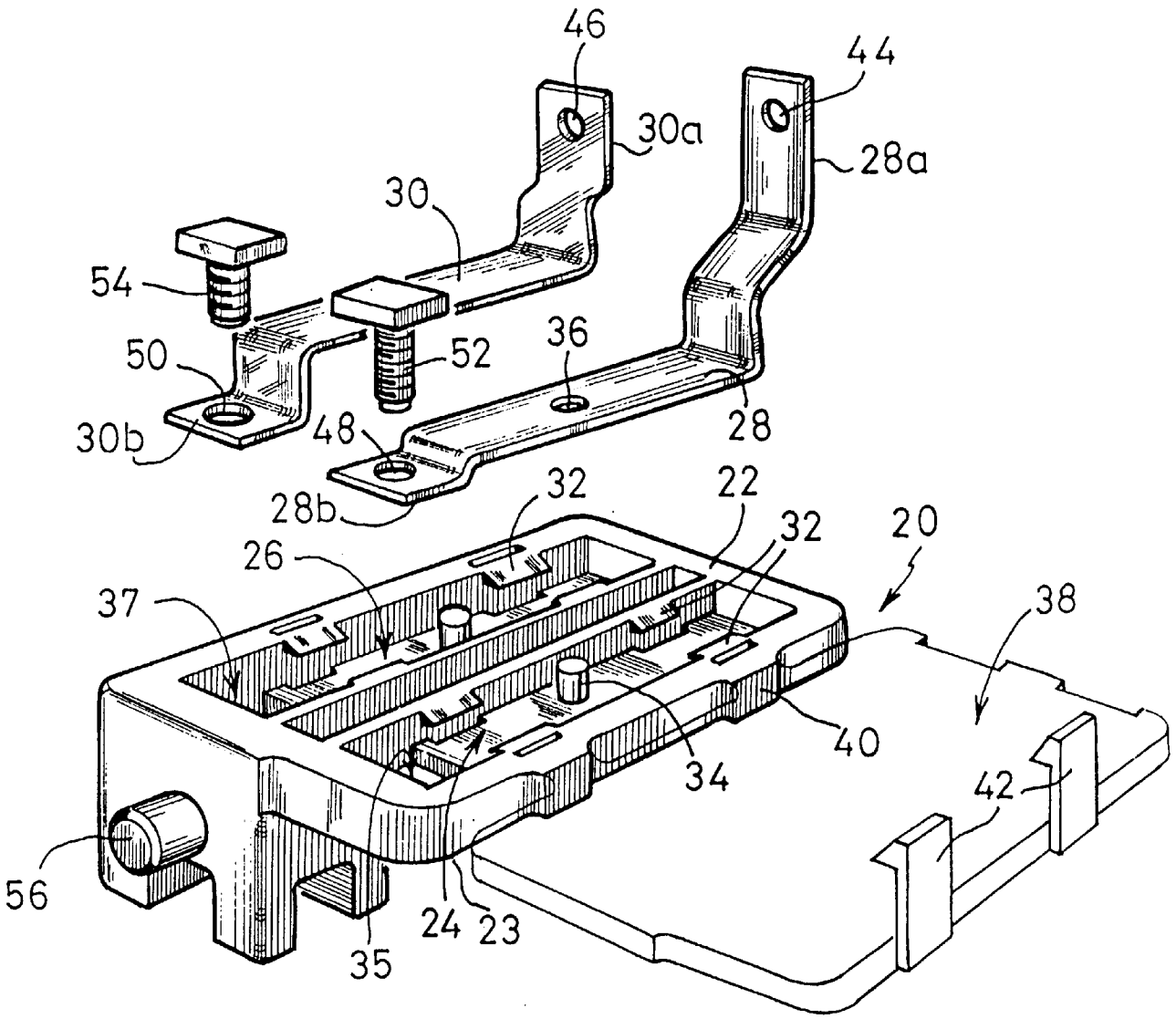
FIG. 3 is an exploded perspective view on a larger scale, of a terminal adaptor, or electrical connector, which is attached on the contactor of the starter, the Figure showing its main component parts.
Figure 4:
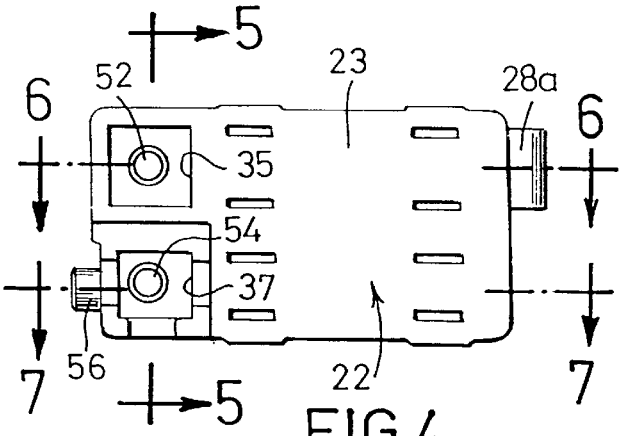
FIG. 4 is a top plan view of the adaptor of the invention.

As can be seen best in FIG. 3, to which reference is also now made, the body 22 of the terminal adaptor 20 is a component of generally elongate flattened form, in which are formed two substantially parallel rectangular troughs or recesses 24 and 26, which receive two connecting elements 28 and 30 in the form of metal bars or strips of rectangular flat cross section. The bars 28 and 30 have dimensions which are so chosen as to give reliable and precise positioning of the bars within the respective recesses 24 and 26, without permitting the connecting bars to be displaced in one direction or another with respect to the insulating body 22.

More precisely, the two recesses 24 and 26 have, on the edges defining their open faces, resilient retaining lugs 32 which are retracted while the connecting bars 28 and 30 are fitted in position by elastic insertion of the bars into the recesses. Once the bars are in place, these retaining lugs 32 regain their original form so as to trap the bars 28 and 30 firmly within the corresponding recesses 24 and 26.

The recesses 24 and 26 also have in their respective bases projecting cylindrical pegs 34, which are received in corresponding holes 36 formed in the central portions of the connecting bars. After the latter have been fitted into the recesses 24 and 26, the free ends of the pegs 34 can be upset by application of heat, so as to form a widened button (shown at 34*a* in FIG. 9), which retains each bar in place against transverse movement in its main plane.

For reasons which will be explained later in this description, each of the recesses 24 and 26 terminates at one end in a through hole 35 and 37 respectively. These holes extend through the base of the body 22, so as to be open in the lower face 23 of the body as shown in FIGS. 3, 6 and 7.

As is indicated in outline in FIG. 3, the insulating body 22 may, alternatively or in addition to the retaining lugs 32, be provided with a cover 38, which is preferably formed integrally by molding with the body 22. The cover 38 is joined to the body 22 through thin portions 40 that constitute hinges for articulation of the cover 38 with respect to the body 22. The cover 38 is formed with a set of hooks or catches 42 on its free edge opposed to the edge which carries the thin film hinges 40; and in the same way, the body 22 is provided with notches (not shown) on its edge opposite to the hinges 40. The catches 42 of the cover 38 engage elastically in these notches.

Figure 5:
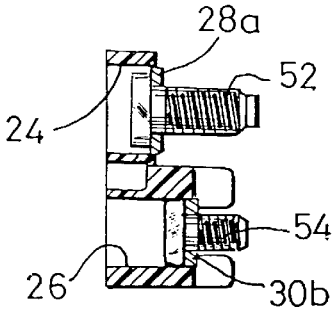
FIG. 5 is a view of the adaptor in transverse cross section taken on the line 5—5 in FIG. 4.
Figure 6:
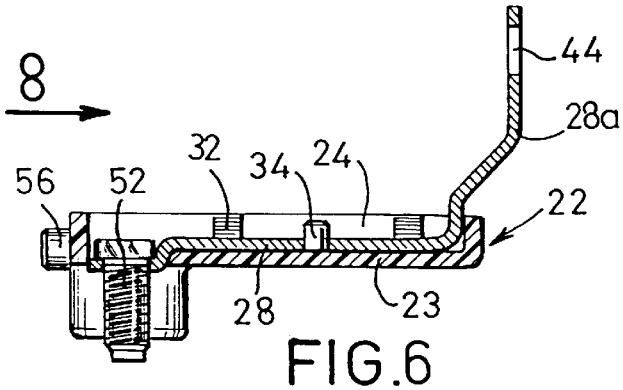
FIG. 6 is a longitudinal view of the adaptor in cross section taken on the line 6—6 in FIG. 5, that is to say along one of its connecting elements.
Figure 8:
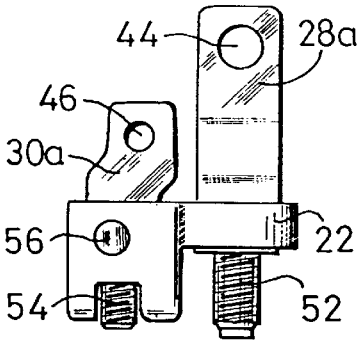
FIG. 8 is an end view of the adaptor as seen in the direction of the arrow 8 in FIG. 6.
Figure 7:
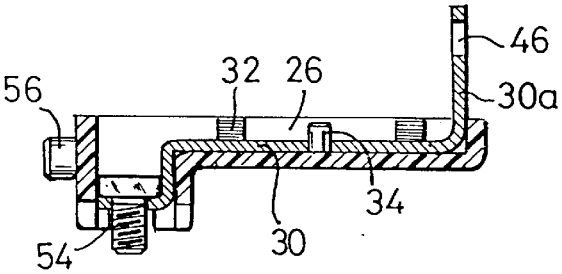
FIG. 7 is a view of the adaptor seen in longitudinal cross section taken on the line 7—7 in FIG. 5, that is to say along the other connecting element.

With reference now to FIGS. 3, 5 and 6, the connecting bars 28 and 30 are bent at 90 degrees at the end associated with the contactor terminals 14, 18, referred to herein as their entry ends 28*a* and 30*a* respectively. These entry ends are formed with respective through holes 44, 46. The diameter of these holes 44 and 46 enables the threaded shanks of the terminals 14 and 18 of the contactor 13 of the starter to pass through them. The other ends of the bars 28 and 30, i.e. their exit ends 28*b* and 30*b* respectively, are slightly offset parallel to the plane of the main body portions of the bars. The exit ends are formed with holes 48 and 50 respectively, through which the threaded shanks or bodies of a pair of square-headed screws 52 and 54 respectively pass. These screws are substantially identical to those of the main terminals 14 and 18 respectively of the contactor 13. The terminal screws 52 and 54 constitute supplementary terminals for the electrical connection of the contactor 13.

The connecting bars 28 and 30 are low-cost components, because they can be made from metal strip or plate by a stamping operation, being then formed to shape by press-forming, bending, and/or stamping. The connecting bar 28 is designed to pass high electric current, and its transverse dimensions should be chosen to be such as to enable such high currents to pass through it without giving rise to excessive heating by Joule effect.

The connecting bar 30 is designed to pass only comparatively low control currents. It can therefore have a smaller transverse cross section. It could however, as the case may be, be less expensive to form the two connecting bars from metal strips of the same thickness, or even from a single strip.

The insulating body 22 of the connector 20 is provided with a projecting fastening element 56, which in this example is in the form of a cylindrical tenon or spigot. The housing of the contactor 13 is formed along its side wall with a complementary recess 58 (see FIG. 1), in the form of a blind cylindrical hole such that the spigot 56 is received in the hole 58 when the terminal adaptor 20 is fixed on the contactor 13.

Figure 9:
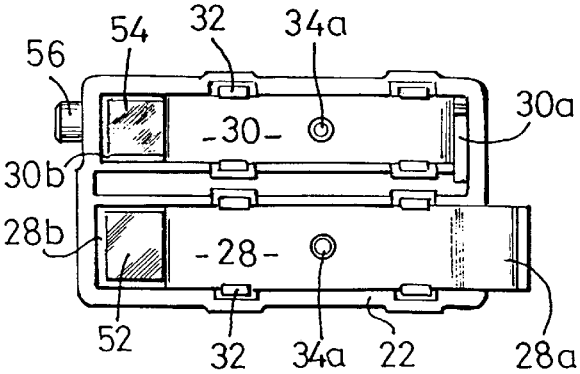
FIG. 9 is a bottom plan view of the adaptor.

The connector or terminal adaptor 20 is assembled in the following way. The body 22, the two connecting bars 28 and 30, and the two screws 52 and 54 are brought together. The two connecting bars 28 and 30 are inserted into their respective recesses 24 and 26, either simultaneously or one after the other, by forcing them past the retaining lugs 32 and introducing the heads 34 through the holes 36 in the connecting bars. The free ends of the pegs 34 are then upset so as to form widened buttons 34*a*, which assist in retaining the connecting bars in place in the base of the recesses 24 and 26, as can be seen in FIG. 9.

The screws 52 and 54 are then inserted into the holes 48 and 50 at the exit ends 28*b* and 30*b* of the connecting bars. These screws are preferably fastened so that they cannot escape and be lost, for example by a seaming operation or by welding or screwing them in place in the holes. For industrial reasons, the screws can be, and preferably are, fastened in place directly on the connecting bars 28 and 30 before the latter are inserted into the recesses 24 and 26. The cover 38 is then closed, and the connector 20 now provides the electrical terminal connections for the contactor.

It will be noted that, firstly, manufacture of the connector 20 can be carried out entirely automatically, and secondly, that in this state it constitutes a pre-assembled modular unitary assembly which can be stored, handled, transported, fitted and replaced separately in an extremely simple and inexpensive way.

With reference again to FIGS. 1 and 2, the fitting and fastening of the connector 20 on the starter will now be described. As to this, the connector 20 is located in position by simultaneously engaging the threaded shanks of the terminals 14 and 18 of the contactor 13 in the holes 44 and 46, in the entry ends 28*a* and 30*a* of the connecting bars 28 and 30 which project at right angles out of the insulating adaptor body 22, while fitting the cylindrical spigot 56 in the recess 58 formed in the casing of the contactor 13.

The nuts 14*a* and 18*a* are then screwed on and subsequently peened over, so as to complete the mechanical fastening of the connector 20 and ensure the proper electrical connection of the connecting bars 28 and 30 to the terminals 14 and 18 respectively of the contactor 13.

In order to prevent separation between the spigot 56 and its recess 58 by any clearance that could cause, in operation, vibrations detrimental to the mechanical strength of the insulating body 22, it is of course arranged that the diameter of the spigot 56 is slightly greater than that of the recess 58, so that the spigot 56 is force-fitted into its recess 58. This should be taken account of in selecting the material for the insulating body 22, although most plastics materials can be suitable for this purpose.

At the end of the operation of fitting and fastening the connector 20 on to the contactor 13, the latter now has two input connecting terminals, that is to say the supplementary terminals 52 and 54. It is these terminals 52 and 54 that are used, in place of the contactor terminals 14 and 18 themselves, for attachment of the spade terminals secured to the ends of the electrical power supply and control lines.

The supplementary terminals 52 and 54 are in this example in a disposition and an orientation in which they lie at 90 degrees with respect to the original or main terminals 14 and 18, and they are spaced apart by a distance of several centimeters, which in most cases makes it possible to put these terminals into a less cramped and more accessible place.

For various reasons, any lack of accessibility may of course be evident in respect of only one of the terminals 14, 16 or 18, in which case the cost can be reduced by providing only one connecting bar 28 or 30, with a smaller insulating body 22, having only one of the recesses 28 or 30. The resulting mechanical fastening is of course then at only two points, but this will be sufficient in most applications.

The pair of fastening elements constituted by the spigot 56 and the corresponding recess 58 may of course be reversed, by providing the recess in the body of the connector 20 and the tenon or spigot on the contactor casing. These elements may also have a non-circular cross section, so as to provide mating cooperation between the connector 20 and the contactor 13 such as to hold the connector in a particular desired orientation.

For a different model of vehicle, it is thus possible to use the same starter, and to design a modified connector or terminal adaptor which brings the supplementary terminals to any desired position, according to the dictates, and preferably taking account of, the space available within the engine compartment of the vehicle. The only obligation is to respect the spatial relationships between the two exit ends 28*a* and 30*a* of the connecting bars, and the spigot 56.

The angle between the axes of the main terminals and the supplementary terminals can of course be other than 90 degrees.

In order to enable positionings to be achieved which are a long way from each other, it is possible to provide a set of recesses 58 on the contactor 13, with the tenon or spigot of the connector 20 engaging in one of these recesses in a first vehicle, while in another vehicle it would be received in a different recess. Where the housing of the contactor 13, or the casing of the starter which may include the contactor housing, is made by molding, forming one or more housings is very simple, and does not involve any additional cost.

What is claimed is:

1. A motor vehicle starter including an electromagnetic contactor, the contactor comprising:

a housing having a casing and an end wall transverse to the casing;

contactor power terminals, each having a body extending through the end wall of the housing and projecting outside the housing for connection to an external power supply circuit for the starter;

a contactor control terminal having a body extending through the end wall of the housing and projecting outside the housing for connection to an electrical control line for controlling the contactor;

an electrical terminal adaptor carried on the outside of the contactor housing, the electrical terminal adaptor comprising:

an insulating adaptor body and at least one conductive connecting element within the insulating adaptor body, said conductive connecting element having an entry end and an exit end, the entry end projecting out of the insulating adaptor body and being connected to a selected one of the contactor power terminals;

at least one supplementary terminal connected electrically to the exit end of said conductive connecting element and extending away from the insulating adaptor body, said supplementary terminal being oriented in a different direction relative to the associated said contactor power terminal and being located behind a plane defined by the end wall in a direction opposite to the direction the body of at least one of the contactor power terminals is projecting outside the housing.

2. A starter according to claim 1, wherein the entry end of said connecting element includes a fastener configured for connecting the conductive connecting element electrically and mechanically onto said contactor power terminal, and at least partly to secure the terminal adaptor mechanically to the contactor.

3. A starter according to claim 1, wherein the insulating adaptor body of the terminal adaptor includes a fastener configured for attaching the adaptor onto the housing of the contactor.

4. A starter according to claim 3, wherein the fastener comprises mating elements.

5. A starter according to claim 1, wherein the contactor housing has a side wall, the insulating body of the terminal adaptor extending longitudinally along the side wall in a direction substantially at right angles to the end wall of the contactor housing.

6. A starter according to claim 5, wherein at least one said supplementary terminal is oriented transversely to the insulating body of the terminal adaptor, in an orientation substantially at right angles to that of the contactor terminal electrically connected to the at least one supplementary terminal.

7. A starter according to claim 1, wherein the contactor housing has a side wall, the insulating body having the general form of a plate adjacent to said side wall, the insulating adaptor body defining a first longitudinal end an a second longitudinal end of said body, the entry end of said connecting element projecting out of the adaptor body in the vicinity of said first end in a transverse direction substantially at right angles to the plate, the associated said supplementary terminal projecting out of the adaptor body in the vicinity of said second end, in the transverse direction but in the opposite sense from that in which the entry end projects out of the adaptor body.

8. A starter according to claim 7, wherein at least one connecting element is a connecting bar of conductive material having an elongate form and a rectangular cross section, having a first end and a second end configured by bending so as to constitute, respectively, the entry end and exit end, the exit end being connected electrically to the associated supplementary terminal.

9. A starter according to claim 1, wherein the insulating body of the terminal adaptor defines at least one recess therein, said recess receiving a said connecting element therein, the recess defining an open face of the recess, the terminal adaptor further including at least one retaining lug carried by the adaptor body and a cover, the cover at least partially obturating the open face of the recess.

10. A starter according to claim 1, wherein said at least one conductive connecting element is an insert encapsulated in the insulating adaptor body, the adaptor body molded around the connecting element.

11. A starter according to claim 1, wherein the insulating body is a component molded from plastic material.

12. A motor vehicle starter including an electromagnetic contactor, the contactor comprising:

a housing having a casing and an end wall transverse to the casing;

contactor power terminals, each having a body extending through the end wall of the housing and projecting outside the housing for connection to an external power supply circuit for the starter; and a contactor control terminal having a body extending through the end wall of the housing and projecting outside the housing for connection to an electrical control line for controlling the contactor, wherein the starter further includes an electrical terminal adaptor carried on the outside of the contactor housing, the electrical terminal adaptor comprising:

at least one supplementary terminal means for conducting electricity between at least one contactor power terminal and the external power supply circuit for the starter;

means for electrically connecting the at least one supplementary terminal means to the associated contactor power terminal;

means for electrically insulating the at least one supplementary terminal means;

means for insulating the at least one supplementary terminal means from the ambient; and means for fastening the electrical terminal adaptor to the contactor of the starter;

wherein said supplementary terminal means is oriented in a different direction relative to the associated said contactor power terminal and is located behind a plane defined by the end wall in a direction opposite to the direction the body of at least one of the contactor power terminals is projecting outside the housing.

* * * * *